US011486565B2

(12) United States Patent
Hikmet et al.

(10) Patent No.: US 11,486,565 B2
(45) Date of Patent: Nov. 1, 2022

(54) ADJUSTABLE LIGHT SOURCE HOLDER, A DIRECTABLE SPOTLIGHT AND A MANUFACTURE METHOD THEREOF

(71) Applicant: SIGNIFY HOLDING B.V., Eindhoven (NL)

(72) Inventors: Rifat Ata Mustafa Hikmet, Eindhoven (NL); Huibert Wouters, Veldhoven (NL); Ties Van Bommel, Horst (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/426,866

(22) PCT Filed: Mar. 16, 2020

(86) PCT No.: PCT/EP2020/057087

§ 371 (c)(1),
(2) Date: Jul. 29, 2021

(87) PCT Pub. No.: WO2020/187831

PCT Pub. Date: Sep. 24, 2020

(65) Prior Publication Data

US 2022/0107081 A1 Apr. 7, 2022

(30) Foreign Application Priority Data

Mar. 21, 2019 (EP) ..... 19164211

(51) Int. Cl.
*F21V 21/30* (2006.01)

(52) U.S. Cl.
CPC ..... *F21V 21/30* (2013.01)

(58) Field of Classification Search
CPC ..... F21V 21/30
See application file for complete search history.

(56) References Cited

U.S. PATENT DOCUMENTS 3,803,400 A * 4/1974 Ozawa ..... B60Q 3/76 362/372
4,499,528 A * 2/1985 Hawlitzki ..... B60Q 3/44 362/372

(Continued)

FOREIGN PATENT DOCUMENTS

GB 2087063 A 5/1982
JP 2016095939 A 5/2016

OTHER PUBLICATIONS

U. Harikrishnan and S. Soundarapandian. "Fused Deposition Modeiing based Printing of Full Complement Bearings", Procedia Manufacturing 26 (2018), pp. 818-825.

*Primary Examiner* — William N Harris

(57) ABSTRACT

The present invention relates to an adjustable light source holder (100), comprising an inner part (110), in the form of a partly spherical shell (214), configured to house a light source; an outer part (120), in the form of a partly spherical shell (324), configured to house and interact with the partly spherical shell of the inner part; wherein the inner part is tiltable relative to the outer part about an arbitrary tilt axis (130); wherein the inner part (110) is made from an elastic material; and wherein an outer surface (212) of the inner part and/or an inner surface (322) of the outer part comprises a rough portion (416, 426). Methods of manufacturing the adjustable light source holder and related directable spotlight systems are also presented.

10 Claims, 6 Drawing Sheets

(56) References Cited

U.S. PATENT DOCUMENTS

| | | | | | |
|---|---|---|---|---|---|
| 5,050,047 | A * | 9/1991 | Viner | G02B 6/0008 | 362/240 |
| 5,183,330 | A * | 2/1993 | Rishel | B60Q 1/0483 | 362/372 |
| 5,377,087 | A * | 12/1994 | Yoon | F21V 21/30 | 362/372 |
| 5,605,394 | A * | 2/1997 | Chen | F21L 4/045 | 362/427 |
| 5,999,686 | A * | 12/1999 | Leaman | G02B 6/0008 | 385/901 |
| 6,019,477 | A | 2/2000 | Wegrzyn et al. | | |
| 6,280,042 | B1 * | 8/2001 | Wegrzyn | F21V 17/168 | 362/322 |
| 6,315,432 | B1 * | 11/2001 | Kuo | G09F 9/33 | 362/276 |
| 6,626,554 | B2 * | 9/2003 | Rincover | F21V 15/012 | 362/186 |
| 7,744,259 | B2 * | 6/2010 | Walczak | F21V 29/89 | 362/373 |
| 8,662,718 | B2 * | 3/2014 | Hashimoto | F21S 8/03 | 362/373 |
| D849,282 | S * | 5/2019 | Kim | D26/24 | |
| 2008/0013326 | A1 * | 1/2008 | Den Boer | F21V 15/01 | 362/364 |
| 2012/0033434 | A1 * | 2/2012 | Wang | F21V 21/30 | 362/366 |
| 2013/0050996 | A1 * | 2/2013 | Holscher | F21S 9/022 | 362/372 |
| 2013/0076269 | A1 | 3/2013 | Shilton | | |
| 2014/0133157 | A1 * | 5/2014 | Froelicher | F21V 33/0012 | 362/373 |

* cited by examiner

ADJUSTABLE LIGHT SOURCE HOLDER, A DIRECTABLE SPOTLIGHT AND A MANUFACTURE METHOD THEREOF

CROSS-REFERENCE TO PRIOR APPLICATIONS

This application is the U.S. National Phase application under 35 U.S.C. § 371 of International Application No. PCT/EP2020/057087, filed on Mar. 16, 2020, which claims the benefit of European Patent Application No. 19164211.5, filed on Mar. 21, 2019. These applications are hereby incorporated by reference herein.

FIELD OF THE INVENTION

The present inventive concept relates to an adjustable light source holder intended for directable spotlights in general lighting applications.

BACKGROUND OF THE INVENTION

Directable, general lighting, spotlights are available on the market today, for domestic or other use environments and may be found in for example ceilings, walls and furniture. Typically, these spotlights are configured by affixing a light source using screws, or similar fixing means, to achieve a desired directional illumination profile of the spotlight. Using screws however, necessitates additional parts to a spotlight system, making it more complex, as well as rendering redirecting of the spotlight cumbersome and complicated. With these issues in consideration, it is clear that there is room for improvement within the technical field.

U.S. Pat. No. 6,019,477 discloses an emergency lighting unit. The unit has a housing with a circular opening, a mounting ring that fits within the opening, a lighting head with a hemispherical shell wherein a lamp is supported, and a semi-spherical mounting member. The mounting member has cantilevered radial fingers, which are positioned to lie between ribs on the hemispherical shell. The radial fingers are designed to bear resiliently against the surface of the hemispherical shell of lighting head, and the engaging surfaces of at least one of the hemispherical shell and the radial fingers may be roughened, or otherwise textured, to increase the amount of frictional engagement therebetween.

SUMMARY OF THE INVENTION

It is an object of the present invention to overcome at least some of the abovementioned problems.

According to a first aspect, an adjustable light source holder is provided. The light source holder comprises an inner part, in the form of a partly spherical shell, configured to house a light source and an outer part, in the form of a partly spherical shell, configured to house and interact with the partly spherical shell of the inner part. The inner part is tiltable relative to the outer part about an arbitrary tilt axis. The inner part is made from an elastic material. An outer surface of the inner part and/or an inner surface of the outer part comprises a rough portion for providing frictional engagement to the other of the surfaces.

By the wording "partly spherical shell" it is implied that the shell structures do not need to be entirely spherical. It is further implied that the shells are not complete and do not entirely enclose the structures that may be situated physically within them. It is further noted that tilting of the inner part relative to the outer part is not limited to just one tilt axis but may be performed about any tilt axis, i.e. it may be said that the inner part may be tilted about an arbitrary tilt axis. Because of this and the partly spherical geometry the inner part may be directed freely. Hence, the inner part does not need to be rotated before any tilting of the same as is often necessitated in the prior art. However, the present design may allow for a rotation of the inner part relative the outer part. The use of rough surface portions serves to engage the inner and outer parts frictionally and maintain the relative orientation between them. This enables the inner part to be forcibly directed and to maintain its orientation even after the force exertion has ceased. Fixing screws are therefore not required to achieve the functionality of maintaining orientation. Additionally, redirecting of the inner part may be performed, without tools as a user may directly tilt the inner part by hand.

Both the outer surface of the inner part and the inner surface of the outer part may comprise a rough portion. The case that both the parts comprise a rough surface for frictionally engaging each other may enable greater control of and more evenly distributed friction between the parts.

The rough portions of the inner and outer parts may overlap. This in order to further increase the effectiveness of the rough portions and facilitate the use of different rough portion types adapted for engaging each other. The rough portions may be adapted to always overlap. The rough portions may also be adapted to overlap in particular sections of the surfaces such that the inner part, and any eventual housed light source, may maintain its orientation towards specific and/or predetermined angles or directions.

A rough portion may cover at least 70%, preferably at least 80%, more preferably at least 90%, most preferably at least 95%, of the respective surface. This may increase the effectiveness of the rough portions in frictionally engaging the inner and outer parts when larger portions of their surface areas are made rough.

The rough portions may be one or more of ribbed, brushed and dotted, structures or textures. Different types of rough portions may be desirable for a variety of reasons. For example, material choice and manufacture method may affect what type is the most optimal or otherwise preferred.

In the adjustable light source holder according to the first aspect, the inner part is made from an elastic material. Alternatively, the outer part may be expandable and the inner part may be rigid. This may allow the two parts to be manufactured separately and then assembled, by pushing the ridged inner part, into the expandable outer part. The outer part may expand elastically during insertion, due to the forces applied, and return to its original form once the inner part is present and confined by the outer part. This may lock the inner part into place while still allowing it to be directable according to the above. The expandable outer part may be designed to feature marginally smaller dimensions compared to the inner part in order to provide more friction and maintain the relative orientation between the parts. The rigid inner part may be made out of for example, but not limited to, rigid polymers.

In the aforementioned alternative configuration, the outer part may be made from an elastic material. This may facilitate the outer part to elastically expand and receive the inner part. An elastic material may comprise any material characterized by being sufficiently elastic. This includes, but is not limited to, materials like natural and synthetic rubbers.

In the aforementioned alternative configuration, the outer part may be made expandable by having a wall of the outer part being segmented into a plurality of wall segments. Having the outer part wall being segmented into smaller segments allow these to separately expand and flex back once the inner part has been inserted. This may expand the list of usable materials for the outer part to include also rigid materials which may have advantages over some elastic materials such as less complex manufacture and better durability in some environments.

In the adjustable light source holder according to the first aspect, the inner part is made from an elastic material. Hence, the inner part may elastically deform temporarily during insertion. Further, the elastic material may enhance the frictional engagement between the inner and outer parts.

The inner part, the outer part and the rough portions of respective part may all comprise the same material but they may also differ in their material composition. Some examples of materials that may be used include: polycarbonate, polyethylene terephthalate, acrylonitrile butadiene styrene, polylactic acid, high-density polyethylene, polyphenylsulfone, high impact polystyrene, fluoropolymers such as polytetrafluoroethylene, natural rubber, and synthetic rubber. Essentially the parts may consist of or comprise any suitable polymer as well as a variety of different materials.

According to a second aspect, a method of manufacturing the adjustable light source holder is provided. The method comprises concurrent fused deposition modelling of the inner and outer parts with the inner part positioned inside the outer part. This method may be used to produce the adjustable light source holder in essentially one go. Assembly of the inner and outer parts would no longer be dependent on applied force and elastic deformation.

Fused deposition modeling (FDM) is a widely used additive manufacturing technology. FDM is commonly used for modeling, prototyping, and production applications. FDM works on an additive principle by laying down material in layers; a plastic filament or metal wire is unwound from a coil and supplies material to produce a part. Possibly, (for thermoplastics for example) the filament is melted and extruded before being laid down. FDM is a rapid prototyping technology. Other terms for FDM are fused filament fabrication (FFF) or filament 3D printing (FDP), which are considered to be equivalent to FDM. In general, FDM printers use a thermoplastic filament, which is heated to its melting point and then extended, layer by layer, (or in fact filament after filament) to create a three-dimensional object. FDM printers are relatively fast, low cost and can be used for printing complicated 3D objects. Such printers are used in printing various parts and shapes using various polymers for a wide range of applications.

The concurrent FDM may be performed such that the inner part cannot be disassembled from the outer part. This may lead to a better fit of the inner part inside the outer part. Furthermore, elastically expanding or deforming details may no longer be necessary if disassembly is regarded as a redundant functionality.

There may be a variety of ways to produce the rough portions of the surfaces of the inner and/or outer parts. For example, rough portions may be formed during the FDM. This may be practical and accomplished relatively effortlessly as FDM often entails an inherent rough finish that could be useful if a surface is intended to frictionally engage another surface. Hence, the method may comprise inherently forming the rough portions of the surfaces of the inner and outer parts using the FDM. The option to have designed rough surface features may yet be used, for example when for creating surfaces which may be adapted and optimized to specifically engage each other.

According to a third aspect an adjustable light source holder manufactured according to the method of the second aspect is provided.

According to a fourth aspect, there is provided a directable spotlight comprising the adjustable light source holder according to the first or third aspect and a light source. The light source may for example comprise, but should not be limited to, LEDs or other solid state lighting, OLED (organic LEDs). To assemble a spotlight system, the light source may be mounted in the adjustable light source holder. This may enable establishing a directional illumination profile that can be quickly reconfigured to fit the needs of the user.

The outer part of the directable spotlight may be fixedly mounted to a substrate. This substrate may for example comprise, but is not limited to, walls, ceilings, furniture and parts of vehicles. The system may be mounted wherever it can fit to the substrate. The substrate may be flat or non-flat and the system may be incorporated into the substrate, protruding minimally or not at all into the room/region to be illuminated.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described as such device may vary. It is also to be understood that the terminology used herein is for purpose of describing particular embodiments only, and is not intended to be limiting. It must be noted that, as used in the specification and the appended claim, the articles "a," "an," and "the," are intended to mean that there are one or more of the elements unless the context clearly dictates otherwise. Thus, for example, reference to "a lamp" or "the lamp" may include several devices, and the like. Furthermore, the words "comprising", "including", "containing" and similar wordings does not exclude other elements or steps.

BRIEF DESCRIPTION OF THE DRAWINGS

The above and other aspects of the present invention will now be described in more detail, with reference to the appended drawings showing embodiments of the invention. The figures should not be considered limiting the invention to the specific embodiment; instead they are used for explaining and understanding the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
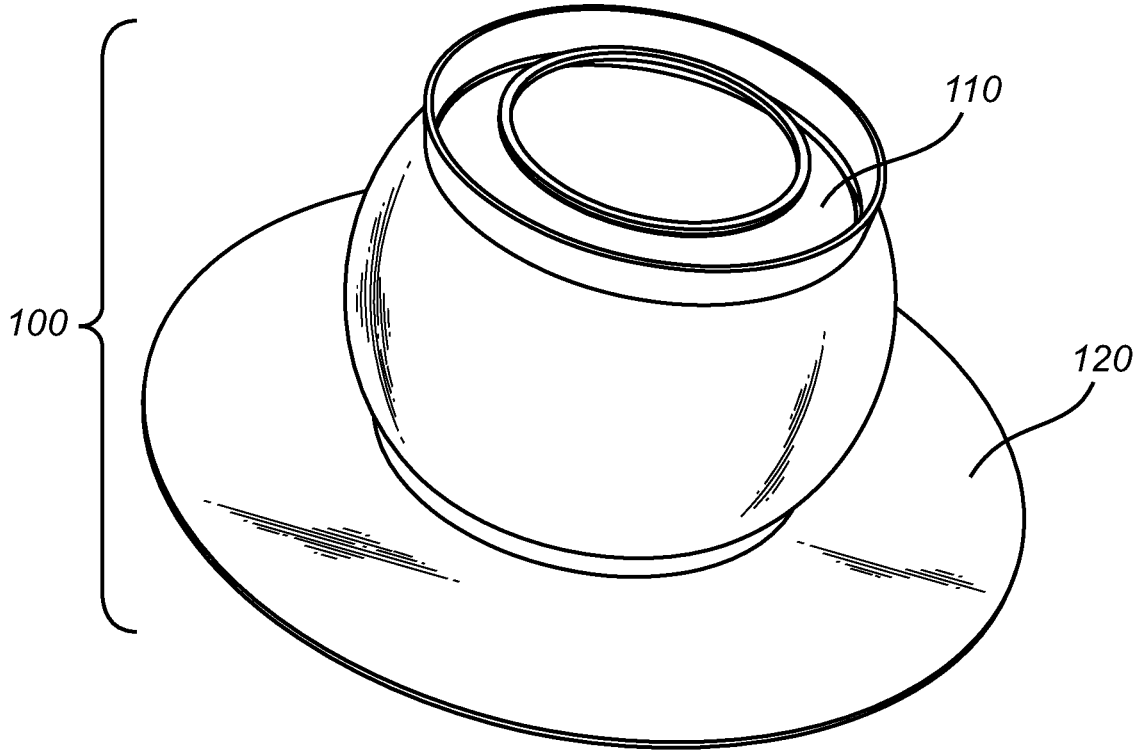
FIG. 1*a* illustrates an adjustable light source holder comprising an outer and an inner part.
Figure 1B:
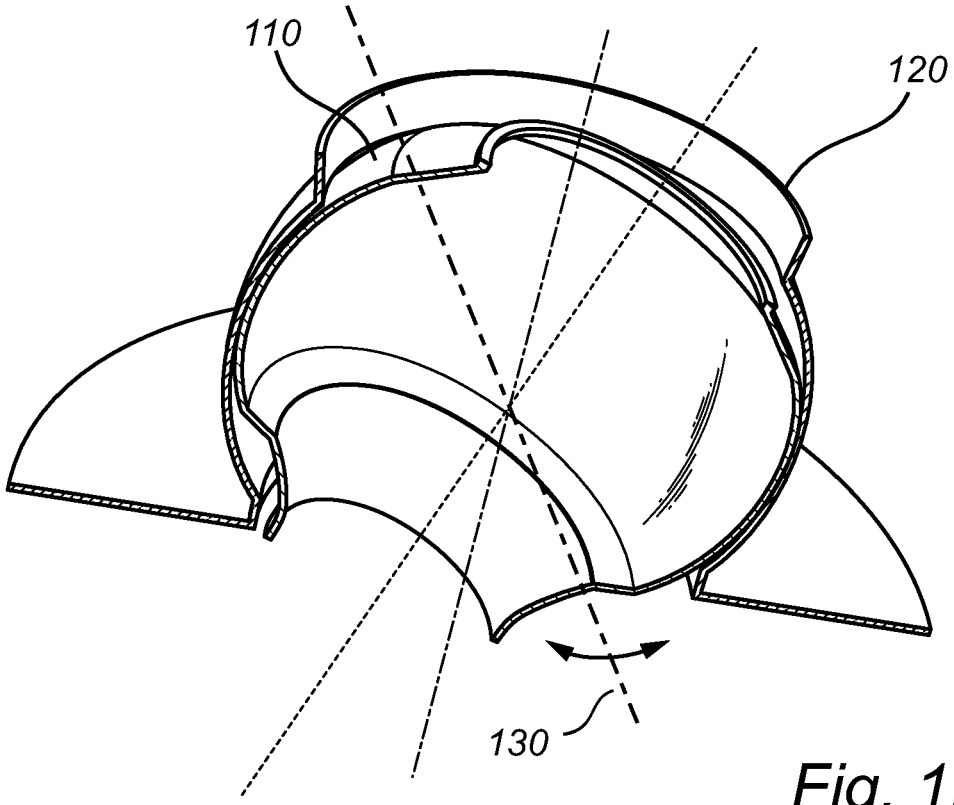
FIG. 1*b* illustrates a cross sectional view of the inner part of the adjustable light source holder as it is being tilted about an arbitrary tilt axis.

In FIG. 1*a*, an adjustable light source holder 100 is illustrated which comprises an inner part 110 and an outer part 120. The inner part 110 is configured to house a light source like for example a LED light source for general lighting applications. Furthermore, the inner part 110 itself is housed within a cavity of the outer part 120 which allows the inner part 110 to be tiltable relative to the outer part 120 about an arbitrary tilt axis 130, as is illustrated in FIG. 1*b*. The inner part 110 may be directed in a variety of different orientations and about more than one arbitrary tilt axis 130. Hence, the inner part 110 may be freely adjusted relative the outer part 120. As a consequence of this, one may direct the illumination profile, of a light source mounted in the adjustable light source holder 100.

Figure 2:
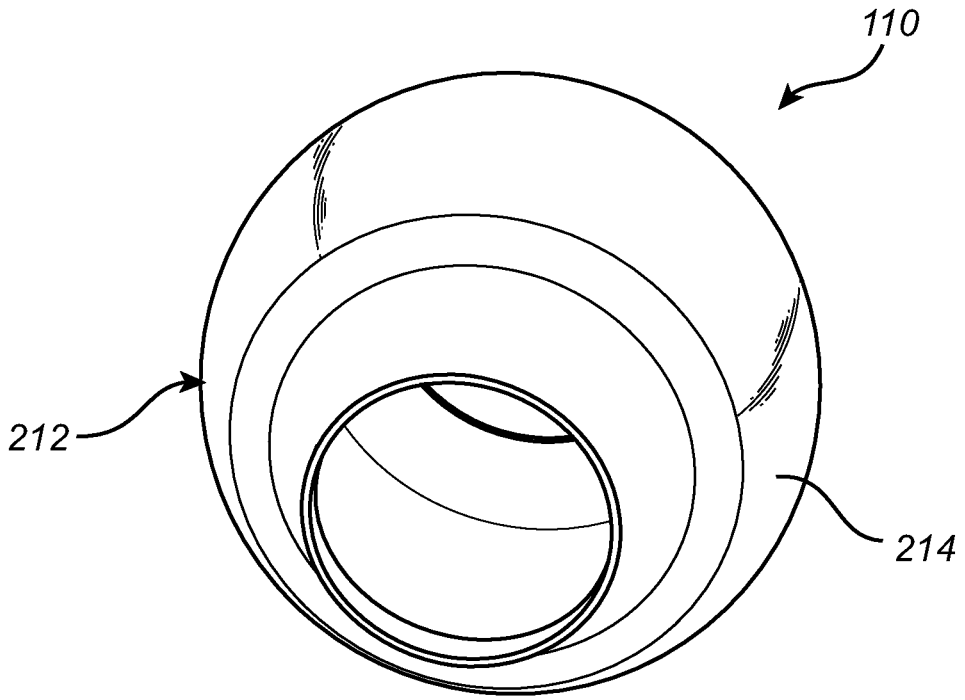
FIG. 2 illustrates the inner part of the adjustable light source holder.

In connection with FIG. 2, the inner part 110 is further described as being in the form of a partly spherical shell 214. The inner part 110 essentially forms a partly spherical shell 214 while not being a fully spherical nor a fully enclosed shell. The inner part 110 further comprises an outer surface 212. The outer surface 212 is configured to interact with an inner surface of the outer part 120. The inner part 110 may in some embodiments be described as having an at least partly spherical, mushroom shaped form but is in no way limited to this appearance. The inner part 110 may also comprise a cavity with at least one opening for attachment of a light source.

Figure 3:
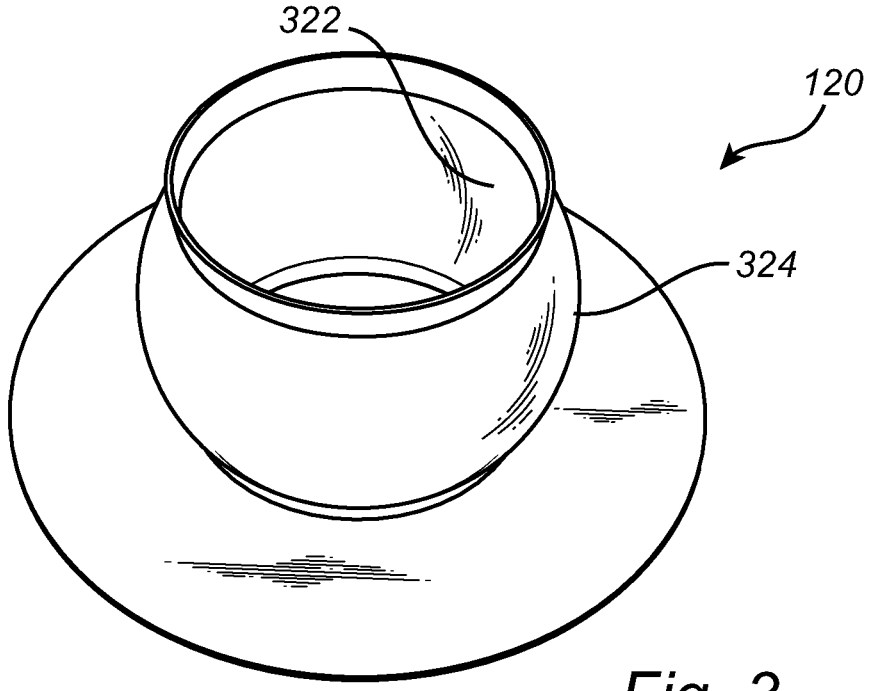
FIG. 3 illustrates the outer part of the adjustable light source holder.

In FIG. 3, it is illustrated that also the outer part 120, is in the form of a partly spherical shell 324. The outer part 120 is configured to house and interact with the partly spherical shell 214 of the inner part 110. The outer part further comprises an inner surface 322. The inner surface 322 is configured to interact with the outer surface 212 of the inner part 110. As mentioned above, the outer surface 212 of the inner part 110 and the inner surface 322 of the of the outer part 120 are configured to interact with each other. Especially, the outer surface 212 of the inner part 110 and the inner surface 322 of the of the outer part 120 are configured to frictionally engage with each other to maintain their relative orientation.

Figure 4:
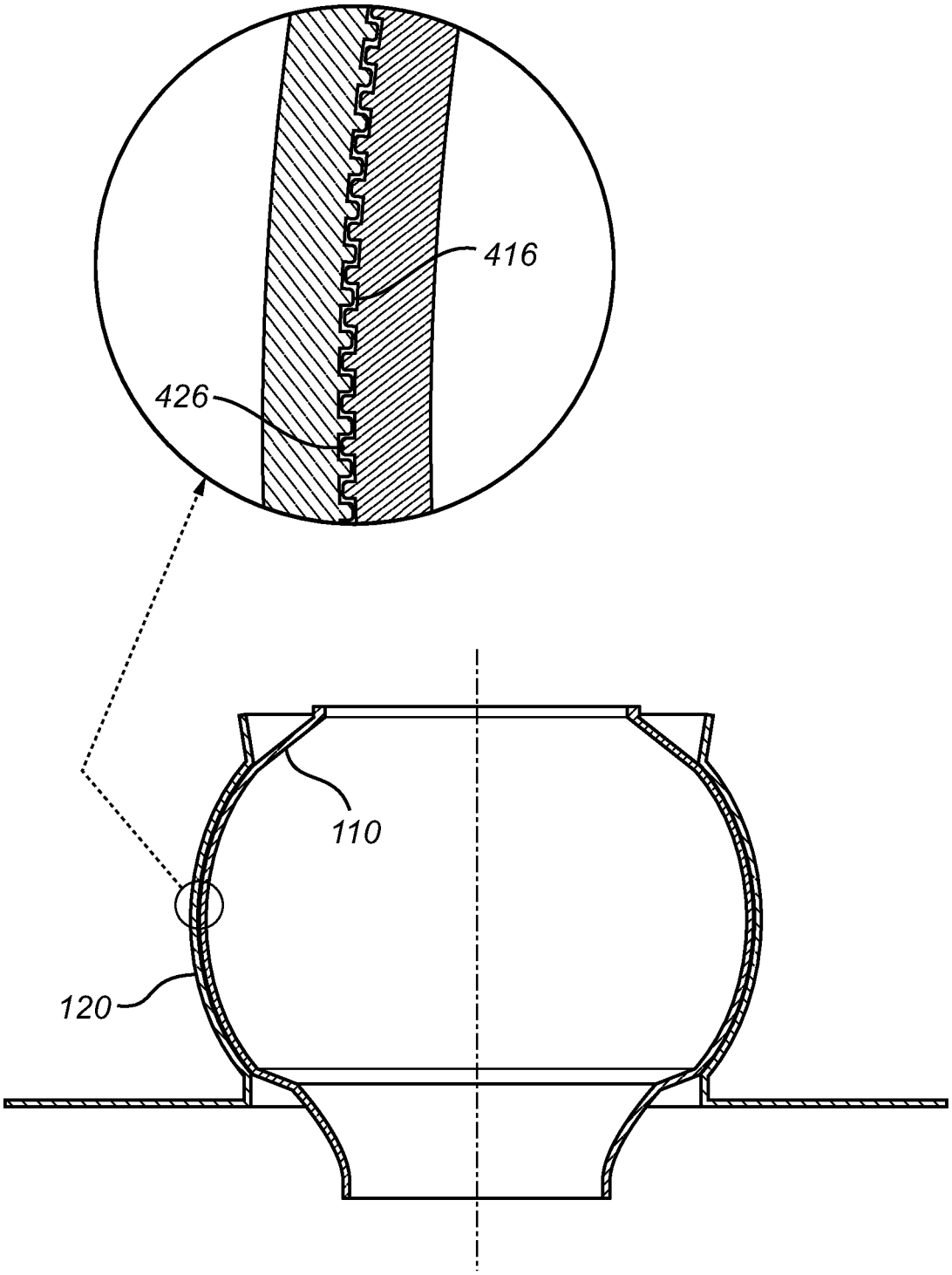
FIG. 4 illustrates the cross section view of how a rough portion of an inner part, outer surface may interact with a rough portion of an outer part, inner surface.

As illustrated in connection with FIG. 4, in order for the outer surface 212 of the inner part 110 and the inner surface 322 of the of the outer part 120 to frictionally engage, one or both of the surfaces 212, 322 comprises a respective rough portion 416, 426. In the in FIG. 4 illustrated example both the outer surface 212 of the inner part 110 and the inner surface 322 of the of the outer part 120 comprises a respective rough portion 416, 426. It is however realized that only the outer surface 212 of the inner part 110 may have a rough portion 426 or only the inner surface 322 of the of the outer part 120 may have a rough portion 416. The rough portions (416, 426) may cover at least 70% of the outer surface (212) of the inner part (110) and/or the inner surface (322) of the outer part (120). Preferably the coverage is at least 80% with at least 90% being more preferred and at least 95% being most preferred.

In the example of FIG. 4 the rough portions are shown to overlap with each other. This may improve their frictional engagement. However, according to other examples the rough portions do not need to overlap, fully nor partially, as long as a frictional engagement between the outer surface 212 of the inner part 110 and the inner surface 322 of the of the outer part 120 is achieved. The rough portions 416, 426 may be located in conjunction with the spherical portions of the partly spherical shells 214, 324. Additionally, the rough portions 416, 426 may comprise at least one different material than that of the surface to which they are part. Preferably, rough portions may comprise rubber or fluoropolymers.

The rough portions 416, 426 serve to provide friction in order to maintain the relative orientation between the inner part 110 and outer part 120. According to some embodiments it is provided that the rough portions 416, 426 may comprise ribbed, brushed or dotted structures or textures. The structures or textures may be based on either periodically repeated or random patterns over the surface. Essentially any non-continuous surface feature or combination of features, rendering a surface less smooth, may form the rough portions 416, 426. It should be mentioned that FIG. 4 shows exaggerated roughness of the rough portions 416, 426. The precise periodicity and the tight interweaving shown, only serves to illustrate an example of how the inner part 110 and the outer part 120 may be frictionally engaged.

Figure 8:
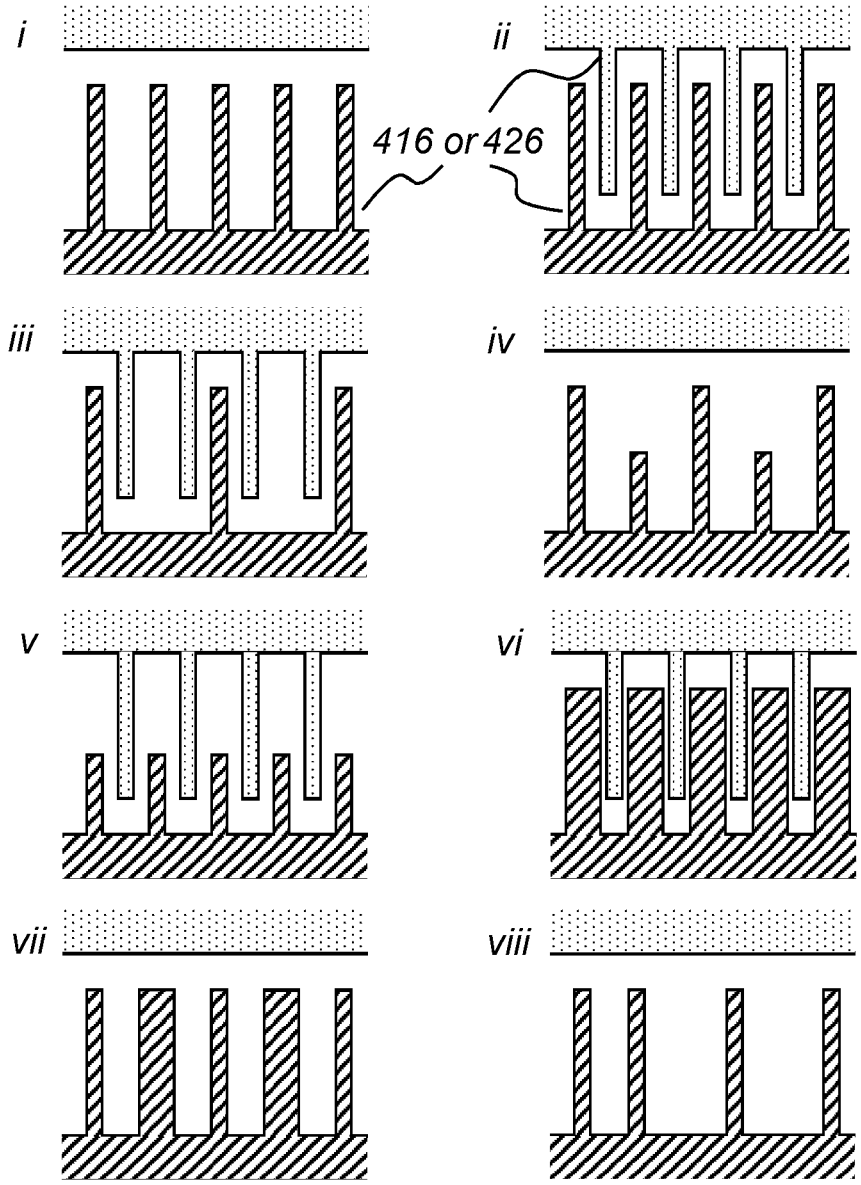
FIG. 8 illustrates various examples of how the rough portions of the inner and outer parts may be realized.

FIG. 8 illustrates a variety of different structures which may constitute the rough portions 416, 426. These include (i) one surface having surface roughness, (ii) both surfaces having surface roughness, (iii) both surfaces having surface roughness but with different spacing, (iv) one surface having surface roughness, with varying height/length of the structures forming the surface roughness, (v) both surfaces having surface roughness, with different height/length, (vi) both surfaces having surface roughness, with different width/radius, (vii) one surface having surface roughness, with varying width/radius and (viii) one surface having surface roughness with varying spacing/pitch. These are just a few examples of structures for the rough portions 416, 426 which may provide favorable frictional engagement between the inner and outer parts 110, 120. Any combination of these as well as additional structures may be considered. It is also to be noted that the relative dimensions of the surface roughness illustrated in FIG. 8 is exaggerative. The example surfaces illustrated in FIG. 8 is not on scale, they are only to be seen to illustrate that the structure on the surface forming the roughness may have different lengths, widths and spacing/pitch.

Typically, the width, radius, and spacing of rough portion features may be in the range of 0.4 to 6 mm. The height of rough portion features may typically be in the range 0.2 to 0.4. It should be mentioned that the actual dimensions may be found to be outside of these, non-limiting ranges.

The partly spherical shell forms of the inner and outer parts 110, 120 may be adapted to concentrically align when the adjustable light source holder 100 is assembled by inserting the inner part 110 into the outer part 120. The inner and outer parts 110, 120 may be made out of a variety of different materials. For example, the inner and outer parts 110, 120 may be made out of a rigid material, such as rigid polymers. The present invention also provides parts made out of expandable materials such as elastic materials. For example, the inner part may be made of a rigid material while the outer part is made of expandable material. This allows a producer to form the two parts separately and assemble the structure by forcibly inserting the inner part into the outer part. According to the invention, the inner part 110 made out of expandable material and the outer part 120 may be made from a rigid material. As light sources tend to produce heat, thermally resistive materials may be used for the inner and outer parts 110, 120. As a general embodiment it is provided that the inner part 110 is made from a first material and the outer part 120 is made from a second material different from the first material.

The inner part 110 may feature a larger radius of the partly spherical shell form 214 compared to the radius of the respective partly spherical shell form 324 of the outer part 120. Even a slight such offset, may lead to an expandable or otherwise deformable inner part 110 being constantly frictionally engaged as the elastic properties of it will work continuously to revert the inner part 110 back to its original extent.

Figure 5:
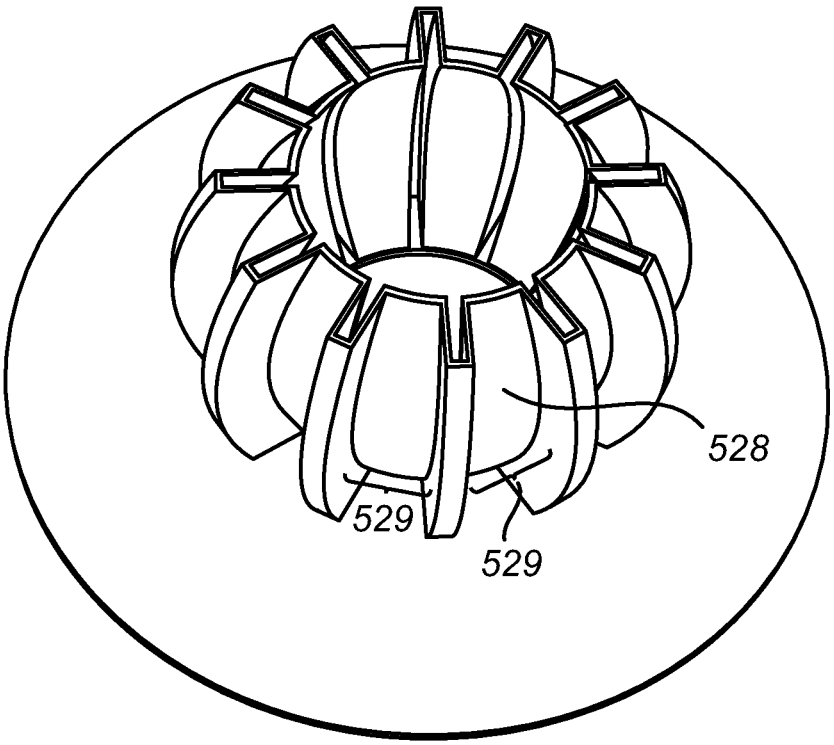
FIG. 5 illustrates an outer part wall being segmented into wall segments.

A different way of achieving an expandable outer part 120 without the use of expanding materials is illustrated by FIG. 5 wherein a wall 528 of the outer part 120 is segmented into a plurality of wall segments 529. By segmenting the wall 528, individual wall segments 529 are provided with more elastic travel compared to if they would form a continuous circle. This makes it possible to use also rigid materials for an elastically expanding/deforming outer part 120. It should still be noted that inherently elastically expandable/deformable materials are in no way excluded from also featuring a segmented wall. In FIG. 5 the wall 528 is segmented into twelve wall segments 529 but other numbers of segments are possible and not excluded from the scope. For example, twelve may be the most preferred number while more than twelve but less than twenty-four is the second most preferred option and less than twelve but more than five is the third most preferred option. FIG. 5 presents protruding portions of the wall 528 between the wall segments 529. The protruding portions are not necessary but may provide stability and robustness to the wall segment parts that may otherwise be damaged after repeated cycles of expansion.

Figure 7:
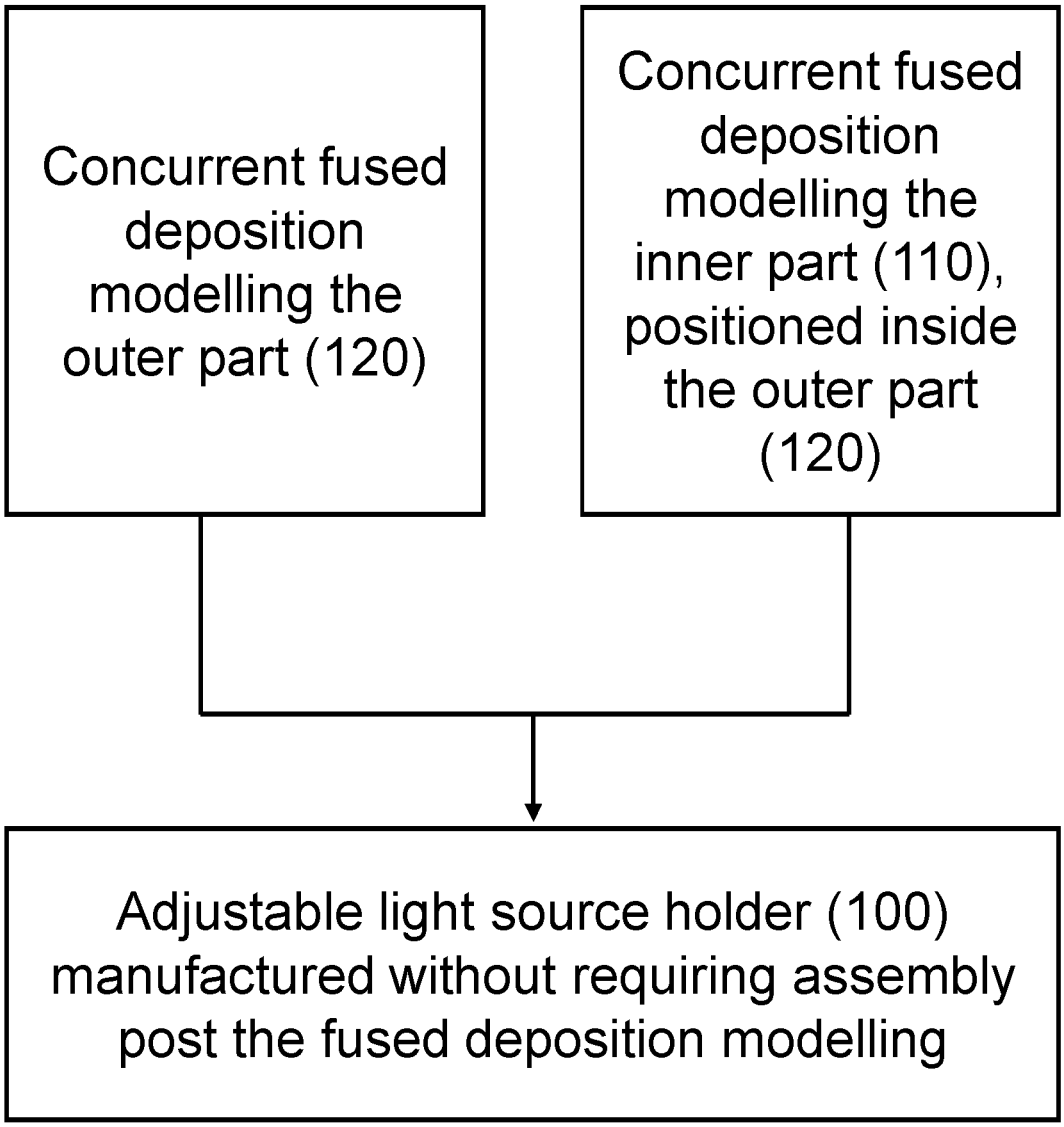
FIG. 7 illustrates a flow chart of the method of manufacturing an adjustable light source holder by concurrent fused deposition modelling.

The adjustable light source holder 100 may, be manufactured by using fused deposition modelling (FDM). According to one embodiment, as is illustrated by FIG. 7, the method of manufacture may comprise having the inner part 110 and the outer part 120 being concurrently formed using FDM with the inner part 110 being positioned inside the outer part 120. One variation of the embodiment further specifies that the concurrent FDM may be designed such that the inner part 110 cannot be disassembled from the outer part. This may be done since FDM may form a plurality of objects from the bottom up. The parts may be formed with temporary connection to each other, for example as a sort of structural umbilical cord. The material and structure constituting this connection may however be adapted so that the connection may be broken, allowing the parts to be reoriented relative to each other with the inner part 110 still being positioned inside the outer part 120. It should be noted that the adjustable light source holder 100 may be manufactured using FDM regardless whether the parts 110, 120 are formed concurrently or not.

According to some embodiments the rough portions 416, 426 of the inner and outer parts 110,120 may be formed during FDM. FDM tends to deposit materials in layers, leading to an inherent roughness, at the finished objects faces, that is based on the resolution of the FDM equipment. It should also be mentioned that any other method of 3D-printing, in addition to FDM may be used to form the adjustable light source holder 100.

Figure 6:
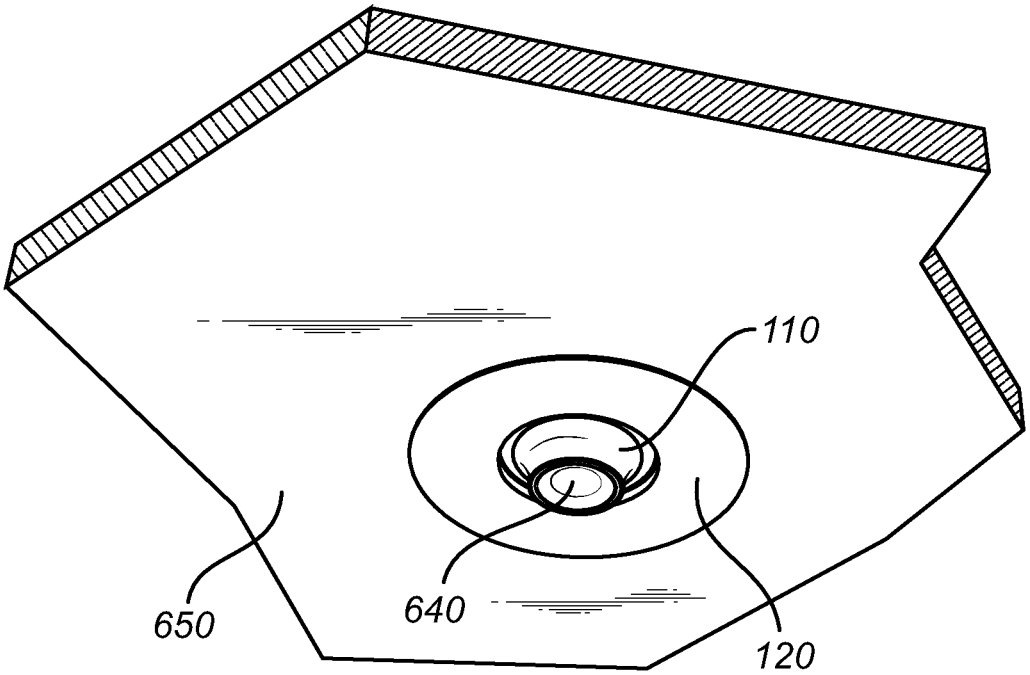
FIG. 6 illustrates a directable spot light system mounted on a substrate wherein a light source is mounted in the adjustable light source holder.

FIG. 6 illustrates the adjustable light source holder 100 in use as part of a directable spotlight system. A light source 640 is attached to the inner part 110 of the adjustable light source holder 100 making it and its illumination profile directable by modification to the relative orientation between the inner and outer parts 110,120. The light source 640 may comprise a LED based light source, incandescent light source, fluorescent light source and various other types of light sources. The light source 640 may be powered by a battery and include a system for recharge like for example photovoltaic cells so that the system may be completely self-contained. Having the light source 640 being conductively powered through a rear side of the light source 640 may however be the more common embodiment.

The directable spotlight system may also, as is shown in FIG. 6, be fixedly mounted to a substrate 650 by the outer part 120 of the adjustable light source holder 100. The substrate 650 may comprise a ceiling or a wall of a building or a piece of furniture but is in no way limited to just these examples.

The person skilled in the art realizes that the present invention by no means is limited to the preferred embodiments described above. On the contrary, many modifications and variations are possible within the scope of the appended claims.

For example, the adjustable light source holder may comprise optical elements such as lenses, total internal reflection collimators, or reflectors. The optical elements may narrow the light distribution from a light source for example by collimating the output light. Collimated light may have an angular intensity distribution full width at half maximum (FWHM) preferably less than 40 degrees, more preferably less than 25 degrees, and most preferably less than 15 degrees. In this way a light source, in combination with the adjustable light source holder, may enable the directing of the output light in different directions and focus it to different surfaces and/or objects. Thereby, desired illumination profiles may be obtained.

Further, the output light with a small angular or spatial intensity distribution may have a maximum intensity at 0 degrees with respect to the light source holder when the inner part is centrally oriented relative to the outer part. By tilting the inner part or by influence of the optical elements, the angle at which maximum output light intensity occurs may preferably be at least 30 degrees, more preferably at least 45 degrees, and most preferably at least 60 degrees.

Moreover, optical elements may be fabricated by using 3D printing techniques such as fused deposition modelling. Optical elements may be integrated or embedded with the adjustable light source holder Further, the adjustable light source holder may comprise a driver and/or a controller and/or an antenna. Electronics and/or optics associated with a light source may be arranged in the inner part. The outer part may be shielded by an external housing with another shape than a sphere, for example a polygonal shape or a cylindrical shape. The external housing may be part of the outer part or a separate part altogether.

Furthermore, a light source considered for use with the adjustable light source holder preferably provides white light. The white light is preferably within 10 standard deviation color matching (SDCM) units from the black body line. The white light has a color temperature preferably in the range from 2200K to 6000 K, more preferably from 2700K to 5000K, and most preferably from 2900K to 4100 K. The color rendering index is preferably at least 80, more preferably at least 85, and most preferably at least 90.

Additionally, variations to the disclosed embodiments can be understood and effected by the skilled person in practicing the claimed invention, from a study of the drawings, the disclosure, and the appended claims.

The invention claimed is:

1. An adjustable light source holder, comprising:

an inner part, in the form of a partly spherical shell, configured to house a light source;

an outer part, in the form of a partly spherical shell, configured to house and interact with the partly spherical shell of the inner part to lock the inner part into place in the outer part;

wherein the inner part is tiltable relative to the outer part about an arbitrary tilt axis;

wherein the outer part is made from a rigid material and the inner part is made from an elastic material so that the inner part is configured to elastically deform temporarily during insertion into the outer part; and wherein an outer surface of the inner part and/or an inner surface of the outer part comprises a rough portion for providing frictional engagement between the inner and outer parts.

2. The adjustable light source holder according to claim 1, wherein both the outer surface of the inner part and the inner surface of the outer part comprises a rough portion.

3. The adjustable light source holder according to claim 2, wherein the rough portions of the inner and outer parts are overlapping.

4. The adjustable light source holder according to claim 1, wherein a rough portion covers at least 70% of the respective surface.

5. The adjustable light source holder according to claim 1, wherein the rough portions are one or more of ribbed, brushed and dotted, structures or textures.

6. A method of manufacturing an adjustable light source holder, the adjustable light source holder comprising:

an inner part, in the form of a partly spherical shell, configured to house a light source; and an outer part, in the form of a partly spherical shell, configured to house and interact with the partly spherical shell of the inner part;

wherein the inner part is tiltable relative to the outer part about an arbitrary tilt axis; and wherein an outer surface of the inner part and/or an inner surface of the outer part comprises a rough portion for providing frictional engagement between the inner and outer parts, wherein the method comprises:

concurrent fused deposition modelling the inner and outer parts with the inner part positioned inside the outer part; and wherein the outer part is made from a rigid material and the inner part is made from an elastic material so that the inner part is configured to elastically deform temporarily during insertion into the outer part.

7. The method according to claim 6, wherein the concurrent fused deposition modelling is designed such that the inner part cannot be disassembled from the outer part.

8. The method according to claim 6, wherein the rough portions of the inner and/or outer parts are formed during the fused deposition modelling.

9. A directable spotlight comprising the adjustable light source holder according to claim 1 and a light source.

10. The directable spotlight according to claim 9, wherein the outer part of the adjustable light source holder is fixedly mounted to a substrate.

* * * * *